US007227435B2

(12) United States Patent
Germain et al.

(10) Patent No.: US 7,227,435 B2
(45) Date of Patent: Jun. 5, 2007

(54) GFCI WITHOUT BRIDGE CONTACTS AND HAVING MEANS FOR AUTOMATICALLY BLOCKING A FACE OPENING OF A PROTECTED RECEPTACLE WHEN TRIPPED

(75) Inventors: Frantz Germain, Rosedale, NY (US); Stephen Stewart, Berrien Springs, MI (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 61 days.

(21) Appl. No.: 11/236,182

(22) Filed: Sep. 26, 2005

(65) Prior Publication Data

US 2006/0022777 A1 Feb. 2, 2006

Related U.S. Application Data

(63) Continuation of application No. 10/331,280, filed on Dec. 30, 2002, now Pat. No. 6,949,994.

(51) Int. Cl.
*H01H 73/00* (2006.01)

(52) U.S. Cl. ..... 335/18; 335/6; 361/42

(58) Field of Classification Search ..... 335/18, 335/6; 361/42

See application file for complete search history.

(56) References Cited

U.S. PATENT DOCUMENTS

| | | | | |
|---|---|---|---|---|
| 4,595,894 | A * | 6/1986 | Doyle et al. | 335/18 |
| 6,040,967 | A * | 3/2000 | DiSalvo | 361/42 |
| 6,246,558 | B1 * | 6/2001 | DiSalvo et al. | 361/42 |
| 6,282,070 | B1 * | 8/2001 | Ziegler et al. | 361/42 |
| 6,288,882 | B1 * | 9/2001 | DiSalvo et al. | 361/42 |
| 6,734,769 | B1 | 5/2004 | Germain et al. | |
| 2004/0203270 | A1 | 10/2004 | Wang | |
| 2005/0013066 | A1 | 1/2005 | Germain et al. | |

* cited by examiner

*Primary Examiner*—Elvin Enad
*Assistant Examiner*—Bernard Rojas
(74) *Attorney, Agent, or Firm*—Paul J. Sutton

(57) ABSTRACT

Located within a GFCI is a movable contact bearing arm which cooperates with at least one fixed contact. When the movable arm is moved up to allow the at least one contact on the arm to close with at least one fixed contact, the GFCI is in a conducting state and current flows from a source of electricity through the closed contacts to a load and to the contacts of a receptacle. When the movable arm is moved down to open the contacts, the GFCI is in a non-conducting state and current cannot flow from the source of electricity to either the load or the receptacle contacts. In this invention, the up and down movement of the movable contact bearing arm is harnessed to move a blocking member located within the housing of the GFCI to a first position to block at least one opening of the receptacle as the movable arm is moved down or to a second position to allow the prongs of a plug to enter the openings of the receptacle as the movable arm is moved up. The downward movement of the movable contact bearing arm occurs when the GFCI goes into a non-conducting state. Resetting the GFCI by pressing in and then releasing a reset button causes the movable contact bearing arm to move up to make contact with the at least one fixed contact. As the movable arm moves up, the blocking member moves to the first or non-blocking position to allow the prongs of a plug to freely enter the openings in the face of the receptacle. GFCI's normally have two separate sets of internally located contacts known as bridge contacts where one set is used to connect a load to the source of electricity and the second set is used to connect a user accessible load to the source of electricity. The bridge contacts provide isolation between the conductors to the load and the conductors to the contacts of the GFCI receptacle when the GFCI is in a non-conducting state. In the GFCI here disclosed, the blocking member prevents the prongs of a plug from entering the receptacle when the GFCI is in a non-conducting state and, therefore, the need for the bridge contacts is diminished.

1 Claim, 8 Drawing Sheets

24
206
60
58
30
114
112
110
120
80
78
RESET
120
102
26
TEST
100
40
54
36
64
60
100
102
74
84
118
82
116
34
72
38
52
62
96
96
98
98
50
93
70
94
92

GFCI WITHOUT BRIDGE CONTACTS AND HAVING MEANS FOR AUTOMATICALLY BLOCKING A FACE OPENING OF A PROTECTED RECEPTACLE WHEN TRIPPED

This application is a continuation of U.S. application Ser. No. 10/331,280, filed Dec. 30, 2002, now U.S. Pat. No. 6,949,994, incorporated herein in its entirety by reference.

BACKGROUND OF THE INVENTION

1. Field

The present invention relates generally to resettable circuit interrupting devices and systems and more particularly to a new improved ground fault circuit interrupter (GFCI) protected receptacle having plug blocking means.

2. Description of the Related Art

Many electrical wiring devices have a line side, which is connectable to an electrical power supply, a load side which is connectable to one or more loads and at least one conductive path between the line and load sides. Electrical connections to wires supplying electrical power or wires conducting electricity to one or more loads can be at the line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI). Presently available GFCI devices, such as the device described in commonly owned U.S. Pat. No. 4,595,894 ('894), use an electrically activated trip mechanism to mechanically break an electrical connection between the line side and the load side. Such devices are resettable after they are tripped by, for example, detection of a ground fault. In the device disclosed in the '894 patent, the trip mechanism used to cause the mechanical breaking of the circuit (i.e., the conductive path between the line and load sides) includes a solenoid (or trip coil). A test button is used to test the trip mechanism and circuitry is provided to sense faults. A reset button is provided to reset the electrical connection between the line and load sides.

However, instances may arise where an abnormal condition such as a lightning strike may result not only in a surge of electricity at the device and a tripping of the device but also the disabling of the trip mechanism used to cause the mechanical breaking of the circuit. This can occur without the knowledge of the user. Under such circumstances an unknowing user, faced with a GFCI which has tripped, may press the reset button which, in turn, will cause the device with an inoperative trip mechanism to be reset without the ground fault protection being available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, a GFCI device which has tripped, may be reset even though the open neutral condition may remain.

Commonly owned U.S. Pat. No. 6,040,967, which is incorporated herein in its entirety by reference, describes a family of resettable circuit interrupting devices capable of locking out the reset portion of the device if the circuit interrupting portion is non-operational or if an open neutral condition exists. Circuit interrupting devices normally have a user accessible load side connection such as a GFCI protected receptacle in addition to line and load side connections such as binding screws. The user accessible load side connected receptacle can be used to connect an appliance such as a toaster or the like to electrical power supplied from the line side. The load side connection and the receptacle are typically electrically connected together. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load connection. This is known as reverse wiring. Such wiring is prevalent in new construction, where power is not yet provided to the residence branch circuits and the electrician has difficulty in distinguishing between the line side and load side conductors. In the event the circuit interrupting device is reverse wired, the user accessible load connection may not be protected, even if fault protection to the load side connection remains. A resettable circuit interrupting device, such as a GFCI device, that includes reverse wiring protection, and optionally an independent trip portion and/or a reset lockout portion is disclosed in U.S. Pat. No. 6,246,558, ('558) assigned to the same assignee as this invention and incorporated herein by reference in its entirety. Patent '558 utilizes bridge contacts located within the GFCI to isolate the conductors to the receptacle contacts from the conductors to the load if the line side wiring to the GFCI is improperly connected to the load side when the GFCI is in a tripped state. The trip portion operates independently of the circuit interrupting portion used to break the electrical continuity in one or more conductive paths in the device. The reset lockout portion prevents reestablishing electrical continuity of an open conductive path if the circuit interrupting portion is not operational or if an open neutral condition exists.

While the breaking of the electrical circuit and the utilization of bridge contacts provides electrical isolation protection between the load conductors and the receptacle contacts when the GFCI is in a tripped state, means which can prevent a plug from being inserted into the receptacle of a GFCI when in a fault state, either with or without the bridge contacts is desired to provide added user safety.

SUMMARY OF THE INVENTION

In one embodiment, the circuit interrupting device such-as a GFCI includes-phase and neutral conductive paths disposed at least partially within a housing between the line and load sides. The phase conductive path terminates at a first connection capable of being electrically connected to a source of electricity, a second connection capable of conducting electricity to at least one load and a third connection capable of conducting electricity to at least one user accessible load through a receptacle. Similarly, the neutral conductive path terminates at a first connection capable of being electrically connected to a source of electricity, a second connection capable of providing a neutral connection to the at least one load and a third connection capable of providing a neutral connection to the at least one user accessible load through the receptacle. The first and second connections can be screw terminals.

The GFCI also includes a circuit interrupting portion disposed within the housing and configured to cause electrical discontinuity in one or both of the phase and neutral conductive paths between the line side and the load side upon the occurrence of a predetermined condition. A reset portion activated by depressing a button disposed at least partially within the housing is configured to reestablish electrical continuity in the open conductive paths.

The GFCI also includes a reset lockout that prevents reestablishing electrical continuity in either the phase or neutral conductive path, or both conductive paths if the circuit interrupting portion is not operating properly. Depression of the reset button causes at least a portion of the phase conductive path to contact at least one reset contact. When contact is made between the phase conductive path and the at least one reset contact the circuit interrupting portion is activated to disable the reset lockout portion and reestablish electrical continuity in the phase and neutral conductive paths.

The GFCI also includes a trip portion that operates independently of the circuit interrupting portion. The trip portion is disposed at least partially within the housing and is configured to cause electrical discontinuity in the phase and/or neutral conductive paths independently of the operation of the circuit interrupting portion. The trip portion includes a trip actuator, such as a button, accessible from the exterior of the housing and a trip arm preferably within the housing and extending from the trip actuator. The trip arm is configured to facilitate the mechanical breaking of electrical continuity in the phase and/or neutral conductive paths when the trip actuator is operated.

Located within the GFCI is a movable contact bearing arm which cooperates with at least one fixed contact. When the movable arm is moved up to allow the contact(s) on the arm to close with the at least one fixed contact, the GFCI is in a conducting state and current flows from a source of electricity through the closed contacts to a load and to the receptacle contacts. When the movable arm is moved down to open the contacts, the GFCI is in a non-conducting state and current cannot flow from the source of electricity to either the load or the receptacle contacts. In this invention, the up and down movement of the movable contact bearing arm is harnessed to move a blocking member to a first position to block at least one opening of the receptacle as the movable arm is moved down or to a second position to allow a plug to enter the openings of the receptacle as the movable arm is moved up. In the invention disclosed, the blocking member is located within the housing of the GFCI and is selectively positioned by the movable arm to assume a first position to block at least one plug receiving opening in the receptacle or is positioned by the movable arm to a second position which does not block the at least one receptacle opening. The blocking member is coupled through a connecting member to the movable arm and is moved to the first or blocking position when the movable contact bearing arm of the GFCI is moved downward and away from the cooperating fixed contacts. This downward movement of the movable contact bearing arm occurs when the GFCI goes into a tripped state. Resetting the GFCI by pressing in and then releasing the reset button causes the movable contact bearing arm to move up to make contact with the fixed contacts. As the movable arm moves up to engage the fixed contacts, the blocking member, acting through the connecting member, moves to the first or non-blocking position to allows a plug to freely enter the openings in the face of the receptacle. GFCI's normally have two separate sets of internally located contacts known as bridge contacts where one set is used to connect a load to the source of electricity and the second set is used to connect a user accessible load to the source of electricity. The bridge contacts provide isolation between the conductors to the load and the conductors to the contacts of the GFCI receptacle when the GFCI is in a fault state. In the GFCI here disclosed, the blocking member prevents the prongs of a plug from entering the receptacle when the GFCI is in a fault state and, therefore, eliminates the need for the bridge contacts.

BRIEF DESCRIPTION OF THE DRAWINGS

Preferred embodiments of the present application are described herein with reference to the drawings in which similar elements are given similar reference characters, wherein.

DETAILED DESCRIPTION

Figure 1:
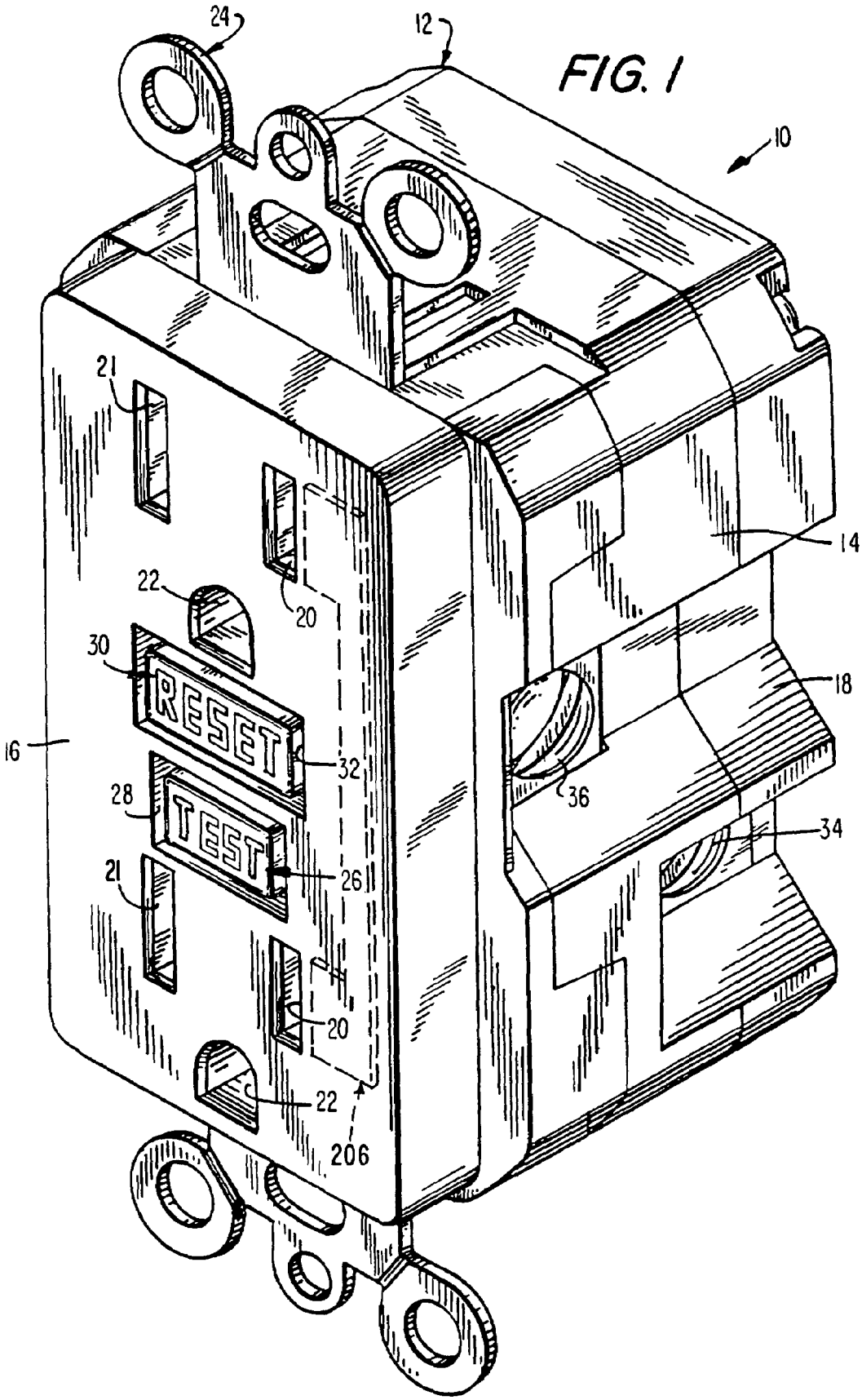
FIG. 1 is a perspective view of an embodiment of a prior art ground fault circuit interrupting (GFCI) device.

The present application contemplates various types of circuit interrupting devices that are capable of breaking at least one conductive path at both a line side and a load side of the device. The conductive path is typically divided between a line side that connects to supplied electrical power and a load side that connects to one or more loads. The term resettable circuit interrupting devices include ground fault circuit interrupters (GFCI's), arc fault circuit interrupters (AFCI's), immersion detection circuit interrupters (IDCI's), appliances leakage circuit interrupters (ALCI's), and equipment leakage circuit interrupters (ELCI's) which have a receptacle for receiving a plug.

For the purpose of the present application, the structure or mechanisms used in the circuit interrupting devices, shown in the drawings and described below, are incorporated into a GFCI protected receptacle which can receive at least one plug and is suitable for installation in a single gang junction box used in, for example, a residential electrical wiring system. However, the mechanisms according to the present application can be included in any of the various resettable circuit interrupting devices.

The GFCI receptacle described herein has line and load phase connectors, line and load neutral connectors and a plug receiving receptacle to provide user accessible load phase and neutral connections. These connectors may be, for example, electrical fastening devices that secure or connect external conductors to the circuit interrupting device, as well as conduct electricity. Examples of such connectors can include binding screws, lugs, terminals and external plug connections.

In one embodiment, the GFCI receptacle has a circuit interrupting portion, a reset portion, a reset lockout and a blocking member to prevent the prongs of a plug from entering the receptacle when the GFCI is in a fault state. The circuit interrupting and reset portions described herein use electromechanical components to break (open) and make (close) one or more conductive paths between the line and load sides of the device. However, electrical components such as solid state switches and supporting circuitry, may be used to open and close the conductive paths.

Generally, the circuit interrupting portion is used to automatically break electrical continuity in one or more conductive paths (i.e. open the conductive path) between the line and load sides upon the detection of a fault, which in the embodiments described can be a ground fault. The reset button is used to close the open conductive paths. The blocking member, which can be positioned to prevent the prongs of a plug from entering the openings in the receptacle when a fault is detected, is activated by a movable arm having at least one of the contacts between the line side and the load side. The reset is used to disable the reset lockout, close the open conductive paths and reset the blocking member to its second or open position to permit a plug to be inserted into the receptacle. The reset and reset lockout portions operate in conjunction with the operation of the circuit interrupting portion, so that electrical continuity cannot be reestablished and the blocking member continues to block at least one opening of the receptacle to prevent the prongs of a plug from entering the receptacle if the circuit interrupting portion is not operational, if an open neutral condition exists and/or if the device is reverse wired.

The above described structure of a blocking member to selectively block at least one opening of the receptacle can be incorporated in any resettable circuit interrupting device, but for simplicity the description herein is directed to GFCI receptacles.

Figure 2:
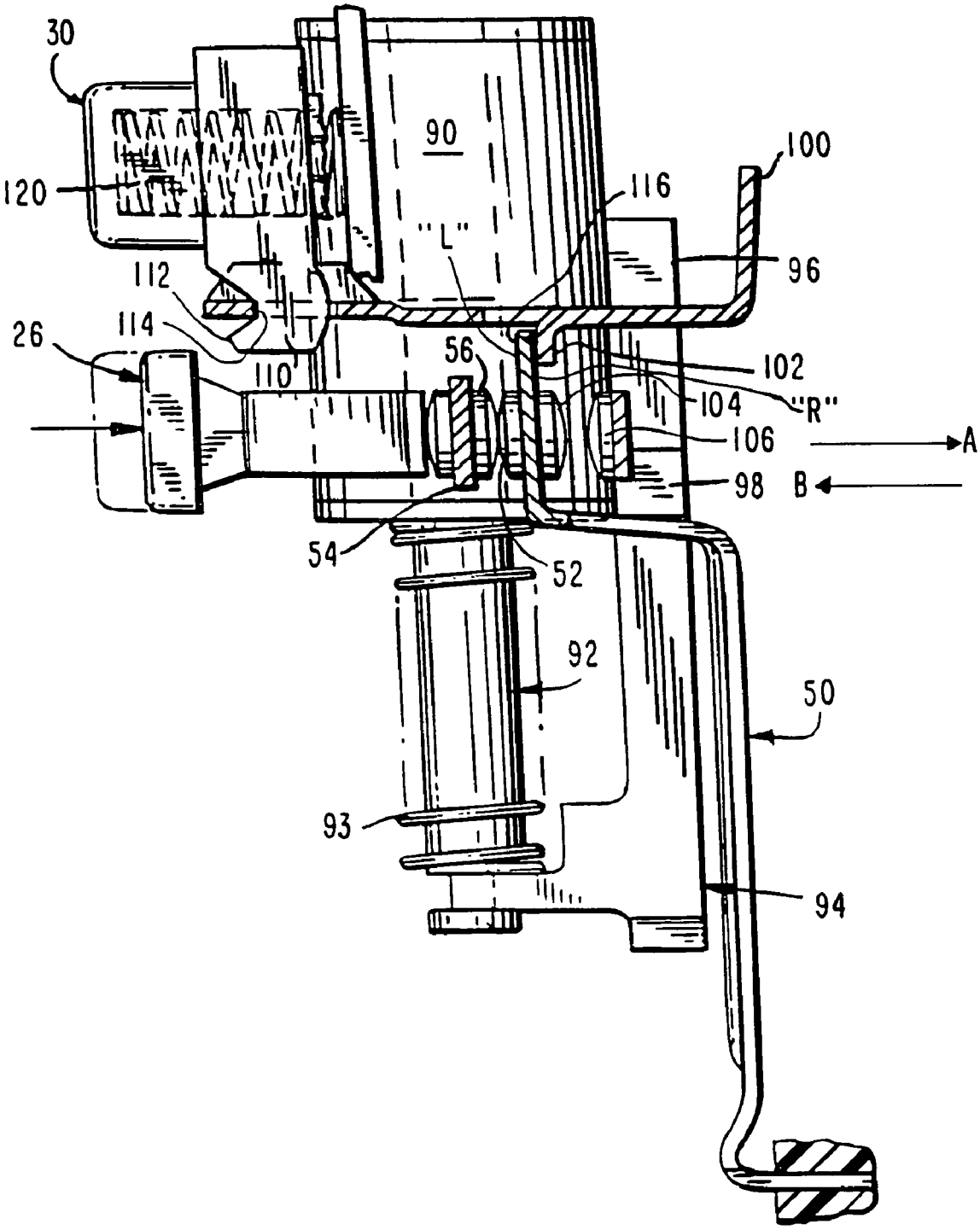
FIG. 2 is a side elevation view, partially in section, of a portion of the GFCI device shown in FIG. 1, illustrating the GFCI device in a set or circuit making position.
Figure 3:
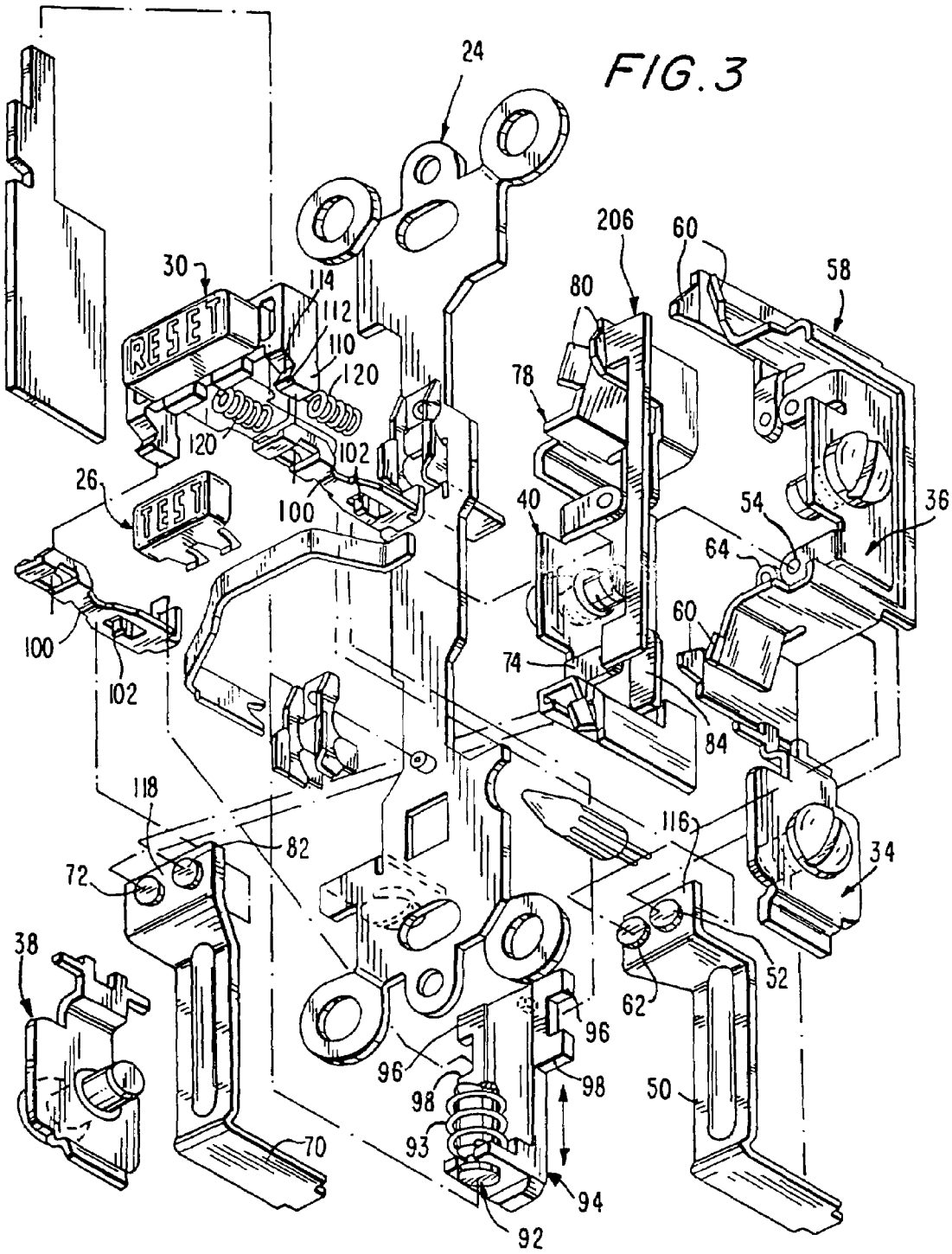
FIG. 3 is an exploded view of internal components of the prior art circuit interrupting device of FIG. 1.
Figure 4:
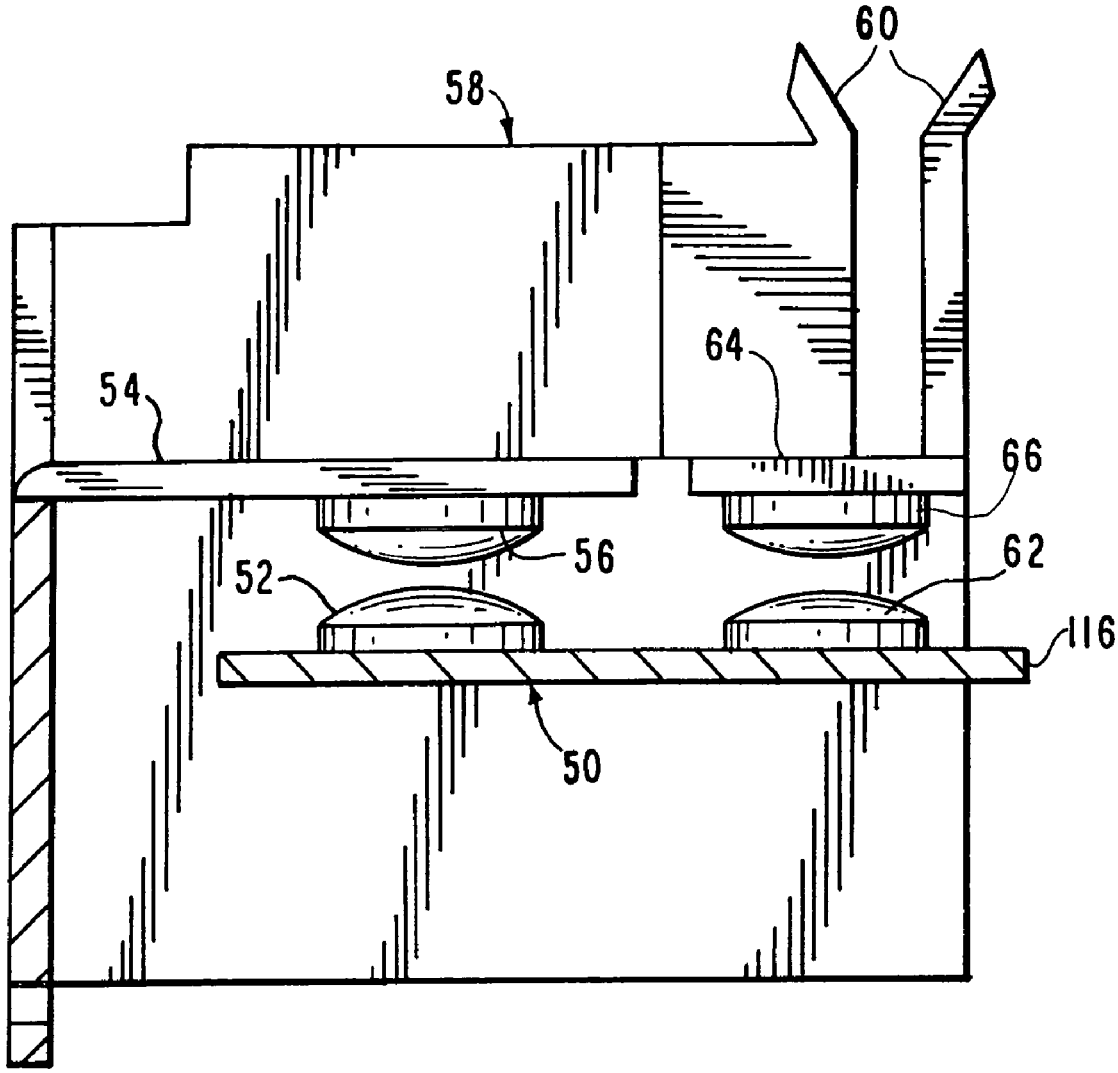
FIG. 4 is a partial sectional view of a portion of a conductive path shown in FIG. 3

FIGS. 1, 2 and 3 are of a ground fault circuit interrupting device such as is disclosed in commonly owned U.S. Pat. No. 6,246,558 which is incorporated herein by reference in its entirety and portions of which are here included to provide a full and complete understanding of the invention disclosed. Turning to FIG. 1, the GFCI receptacle 10 has a housing 12 consisting of a relatively central body 14 to which a face or cover portion 16 and a rear portion 18 are removably secured. The face portion 16 has entry ports 20 and 21 for receiving normal or polarized prongs of a male plug of the type normally found at the end of a lamp or appliance cord set, as well as ground prong receiving openings 22 to accommodate a three wire plug. The receptacle also includes a mounting strap 24 used to fasten the receptacle to a junction box.

A test button 26 which extends through opening 28 in the face portion 16 of the housing 12 is used to activate a test operation that tests the operation of the circuit interrupting portion (or circuit interrupter) disposed in the device. The circuit interrupting portion, to be described in more detail below, is used to break electrical continuity in one or more conductive paths between the line and load side of the device. A reset button 30 forming a part of the reset portion extends through opening 32 in the face portion 16 of the housing 12. The reset button is used to activate a reset operation, which reestablishes electrical continuity to open conductive paths. Electrical connections to existing household electrical wiring are made via binding screws 34 and 36, where screw 34 is an input or line phase connection, and screw 36 is an output or load phase connection. Two additional binding screws 38 and 40 (see FIG. 2) are located on the opposite side of the receptacle 10. These additional binding screws provide line and load neutral connections, respectively. A more detailed description of a GFCI receptacle is provided in U.S. Pat. No. 4,595,894, which is incorporated herein in its entirety by reference. Binding screws 34, 36, 38 and 40 are exemplary of the types of wiring terminals that can be used to provide the electrical connections. Examples of other types of wiring terminals include set screws, pressure clamps, pressure plates, push-ion type connections, pigtails and quick connect tabs.

The conductive path between the line phase connector 34 and the load phase connector 36 includes movable arm 50 which is movable between a stressed and an unstressed position, movable contact 52 mounted to the movable arm 50, contact arm 54 secured to or is monolithically formed into the load phase connection 36 and fixed contact 56 mounted to the contact arm 54. The user accessible load phase connection for this embodiment includes terminal assembly 58 having two binding terminals 60 which are capable of engaging a prong of a male plug inserted there between. The conductive path between the line phase connection 34 and the user accessible load phase connection includes movable arm 50, movable contact 62 mounted to movable arm 50, contact arm 64 secured to or is monolithically formed into terminal assembly 58, and fixed contact 66 mounted to contact arm 64. These conductive paths are collectively called the phase conductive path.

Similar to the above, the conductive path between the line neutral connector 38 and the load neutral connector 40 includes movable arm 70 which is movable between a stressed and an unstressed position, movable contact 72 mounted to arm 70, contact arm 74 secured to or is monolithically formed into load neutral connection 40, and fixed contact 76 mounted to the contact arm 74. The user accessible load neutral connection for this embodiment includes terminal assembly 78 having two binding terminals 80 which are capable of engaging a prong of a male plug inserted there between. The conductive path between the line neutral connector 38 and the user accessible load neutral connector includes, movable arm 70, contact arm 84 secured to or monolithically formed into terminal assembly 78, and fixed contact 86 mounted to contact arm 84. These conductive paths are collectively called the neutral conductive path.

Referring to FIG. 2, the circuit interrupting portion has a circuit interrupter and electronic circuitry capable of sensing faults, e.g., current imbalances, on the hot and/or neutral conductors. In an embodiment for the GFCI receptacle, the circuit interrupter includes a coil assembly 90, a plunger 92 responsive to the energizing and de-energizing of the coil assembly and a banger 94 connected to the plunger 92. The banger 94 has a pair of banger dogs 96 and 98 which interact with movable latching members 100 used to set and reset electrical continuity in one or more conductive paths. The coil assembly 90 is activated in response to the sensing of a ground fault by, for example, the sense circuitry shown in FIG. 5 that includes a differential transformer that senses current imbalances.

The reset portion includes reset button 30, the movable latching members 100 connected to the reset button 30, latching fingers 102 and normally open momentary reset contacts 104 and 106 that temporarily activate the circuit interrupting portion when the reset button is depressed, when in the tripped position. The latching fingers 102 are used to engage side R of each arm 50, 70 and move the arms 50, 70 back to the stressed position where contacts 52, 62 touch contacts 56, 66 respectively, and where contacts 72, 82 touch contacts 76, 86 respectively.

The movable latching members 102 can be common to each portion (i.e., the circuit interrupting, reset and reset lockout portions) and used to facilitate making, breaking or locking out of electrical continuity of one or more of the conductive paths. However, the circuit interrupting devices according to the present application also contemplate embodiments where there is no common mechanism or member between each portion of between certain portions. Further, the present application also contemplates using circuit interrupting devices that have circuit interrupting, reset and reset lockout portions to facilitate making, breaking or locking out of the electrical continuity of one or both of the phase or neutral conductive paths.

In the embodiment shown in FIGS. 2 and 3, the reset lockout portion includes latching fingers 102 which after the device is tripped, engages side L of the movable arms 50, 70 so as to block the movable arms 50, 70 from moving. By blocking movement of the movable arms 50, 70, contacts 52 and 56; contacts 62 and 66; contacts 72 and 76; and contacts 82 and 86 are prevented from touching. Alternatively, only one of the movable arms 50 or 70 may be blocked so that their respective contacts are prevented from touching. Further, in this embodiment, latching fingers 102 act as an active inhibitor to prevent the contacts from touching. Alternatively, the natural bias of movable arms 50 and 70 can be used as a passive inhibitor that prevents the contacts from touching.

Referring to FIG. 2, the GFCI receptacle is shown in a set position where movable contact bearing arm 50 is in a stressed condition so that movable contact 52 is in electrical engagement with fixed contact 56 of contact arm 54. If the sensing circuitry of the GFCI receptacle senses a ground fault, the coil assembly 90 is energized to draw plunger 92 into the coil assembly 90 and banger 94 moves upwardly. As the banger moves upward, the banger front dog 98 strikes the latch member 100 causing it to pivot in a counterclockwise direction about the joint created by the top edge 112 and inner surface 114 of finger 110. The movement of the latch member 100 removes the latching finger 102 from engagement with side R of the remote end 116 of the movable contact bearing arm 50, and permits the arm 50 to return to its pre-stressed condition opening contacts 52 and 56.

After tripping, the coil assembly 90 is de-energized, spring 93 returns plunger 92 to its original extended position and banger 94 moves to its original position releasing latch member 100. At this time, the latch member 100 is in a lockout position where latch finger 102 inhibits movable contact 52 from engaging fixed contact 56. One or both latching fingers 102 can act as an active inhibitor to prevent the contacts from touching. Alternatively, the natural bias of movable arms 50 and 70 can be used as a passive inhibitor that prevents the contacts from touching.

To reset the GFCI receptacle so that contacts 52 and 56 are closed and continuity in the phase conductive path is re-established, the reset button 30 is depressed sufficiently to overcome the bias force of return spring 120 and moves the latch member 100 in the direction of arrow A. Depressing the reset button 30 causes the latch finger 102 to contact side L of the movable contact arm 50 and, continued depression of the reset button 30, forces the latch member to overcome the stress force exerted by the arm 50 to cause the reset contact 104 on the arm 50 to close on reset contact 106. Closing the reset contacts activates the operation of the circuit interrupter by, for example simulating a fault, so that plunger 92 moves the banger 94 upwardly striking the latch member 100 which pivots the latch finger 102, while the latch member 100 continues to move in the direction of arrow A. As a result, the latch finger 102 is lifted over side L of the remote end 116 of the movable contact bearing arm 50 onto side R of the remote end of the movable contact arm. Movable arm 50 now returns to its unstressed position, opening contacts 52, 56; and contacts 62, 66 to terminate the activation of the circuit interrupting portion, thereby de-energizing the coil assembly 90.

After the circuit interrupter operation is activated, the coil assembly 90 is de-energized, plunger 92 returns to its original extended position, banger 94 releases the latch member 100 and latch finger 102 is in a reset position. Release of the reset button causes the latching member 100 and movable contact arm 50 to move in the direction of arrow B until contact 52 electrically engages contact 56, as seen in FIG. 2.

Figure 6:
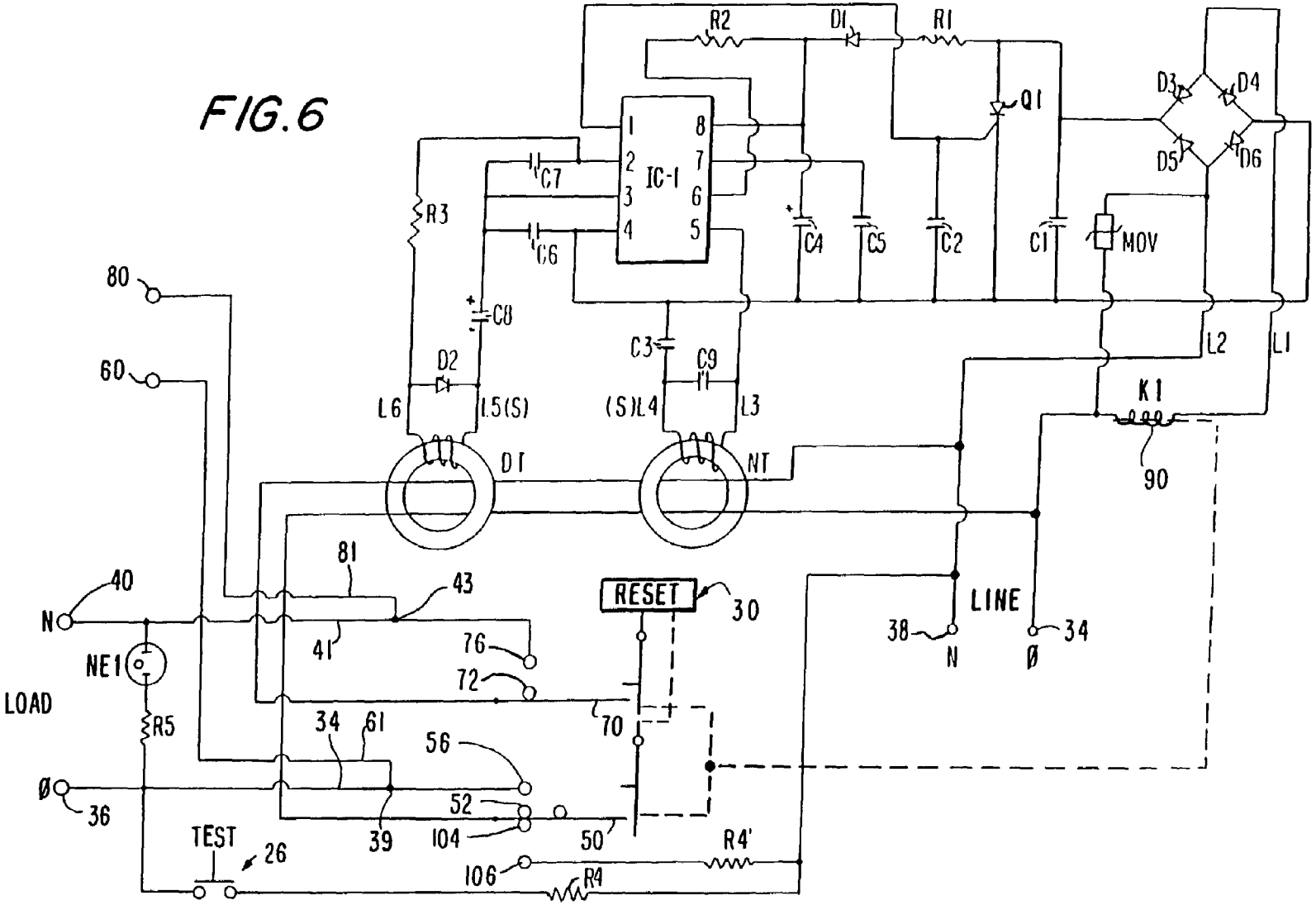
FIG. 6 is a schematic diagram of a ground fault circuit interrupting device which has no bridge contacts; and, FIGS. 7 and 8 are partial perspective views of the internal components of a ground fault circuit interrupting device showing a blocking member in accordance with the principles of the invention.
Figure 7:
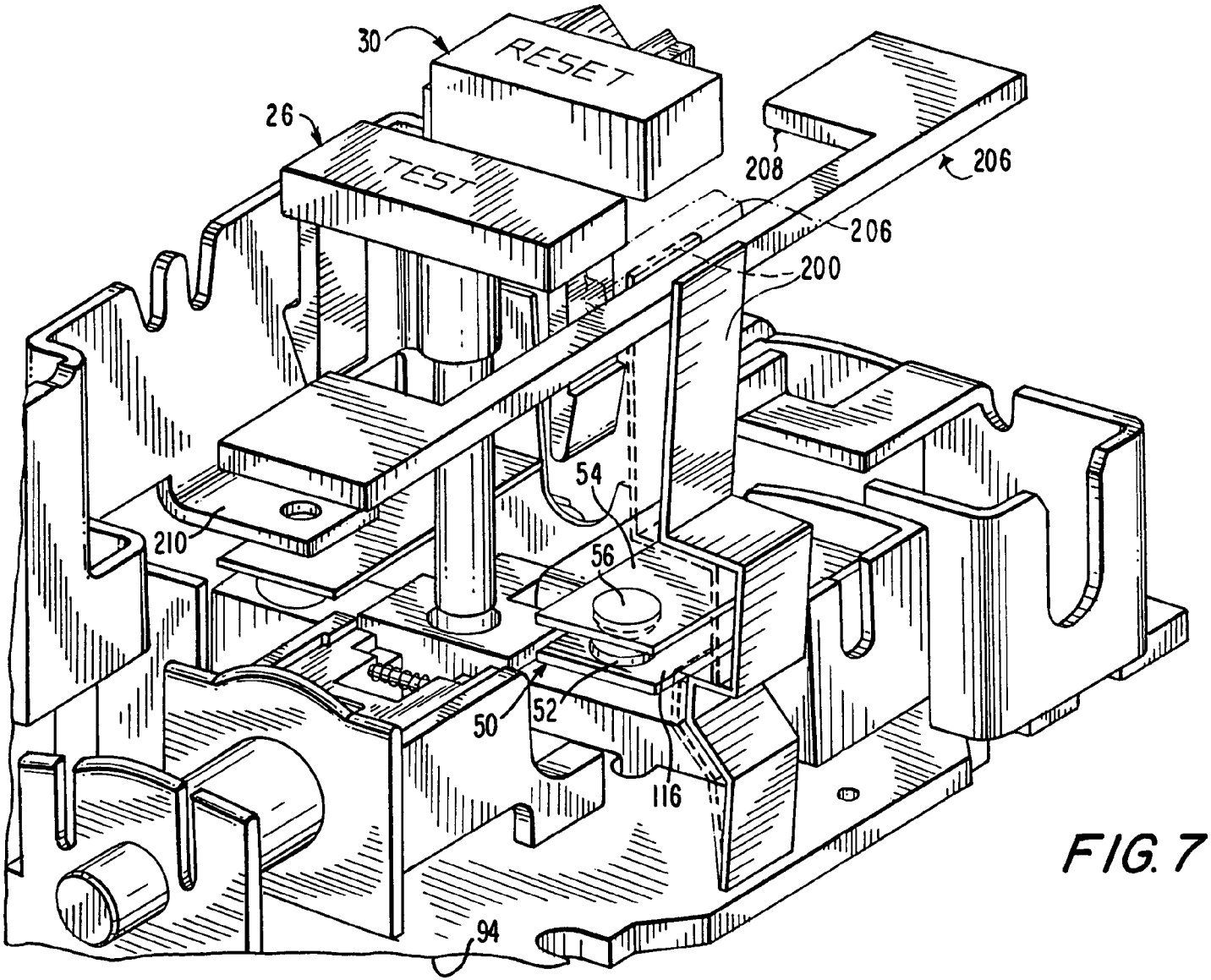
Figure 8:
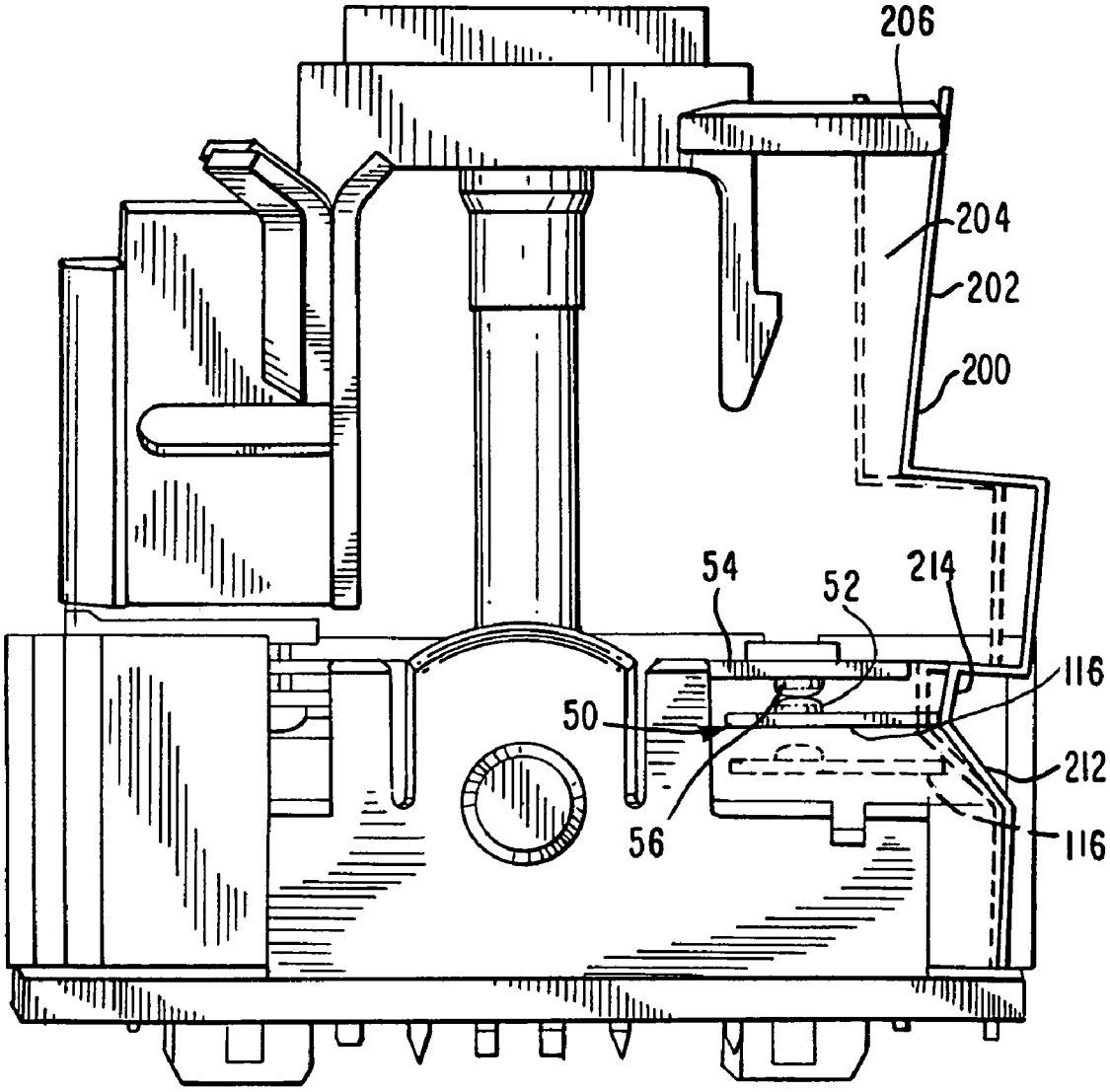

Referring to FIGS. 6 and 7, there is shown a GFCI having a blocking member which is selectively operated to block plug receiving openings in the face of the receptacle when the GFCI is in its tripped state. Connecting member 200 which can be fixed at one end to be a cantilever member is movable between a stressed position 202 and an unstressed position 204 and is coupled to a U shaped blocking member 206 having blocking ends 208, 210. Referring to FIG. 1, the blocking member 206 (shown in dotted outline), which is made of insulating material, can be located within the body 16 and immediately behind the face portion of housing 12 and has blocking ends 208, 210. The ends are positioned to assume a first position which blocks at least one opening, such as openings 20 of the receptacle or a second position which does not block the openings in the receptacle. The blocking ends of the blocking member, when in the first position, can be located between the plug receiving openings in the face portion of the receptacle and the top end of the electrical contacts associated with that opening. Returning to FIGS. 6 and 7, cantilever member 200 has a wedge or ramp section 212 which connects to a land section 214. Cantilever member 200 is positioned to allow an edge of the free end 116 of the movable arm 50 to engage the wedge or ramp section 212 and the land section 214 of cantilever member 200. The geometries of the wedge section 212 and the land section 214 of the cantilever member 200, and their positions relative to each other are such that movable arm 50 contacts the land section 214 to position the cantilever member to its stressed condition when the GFCI is not in a fault state; and the movable arm 50 contacts the bottom of the ramp section to allow the cantilever member to assume its unstressed condition when the GFCI is in a fault state. As can be seen from FIGS. 1, 6 and 7, when the GFCI is not in a fault condition, movable arm 50 is in position X (see FIG. 7) and is in contact with the land section of the cantilever member 200 which positions the cantilever member to its stressed condition.

When the cantilever member is in its stressed condition, blocking member 206 is moved toward the right as illustrated by 202 of FIG. 7, and the blocking ends 208, 210 are positioned to allow the prongs of a plug to freely enter the receptacle openings. Similarly, when the cantilever member is in its unstressed condition, the blocking member 206 is moved toward the left as illustrated by 204 of FIG. 7, and the blocking ends 208, 210 are positioned behind the openings of the receptacle to prevent the prongs of a plug from entering the receptacle.

Thus, in operation, the blocking member blocks the receptacle openings when the GFCI is in the tripped state. Once a reset is attempted, if functional, as the reset button is released it lifts the movable arm 50 which closes the main contacts. As this happens, the side edge of the arm 50 which supports a movable contact engages the ramp section 212 of the cantilever member 200 and moves it to its stressed condition. As the cantilever member moves into its stressed condition, the blocking ends are displaced from the face openings of the receptacle and the prongs of a plug can be inserted.

Figure 5:
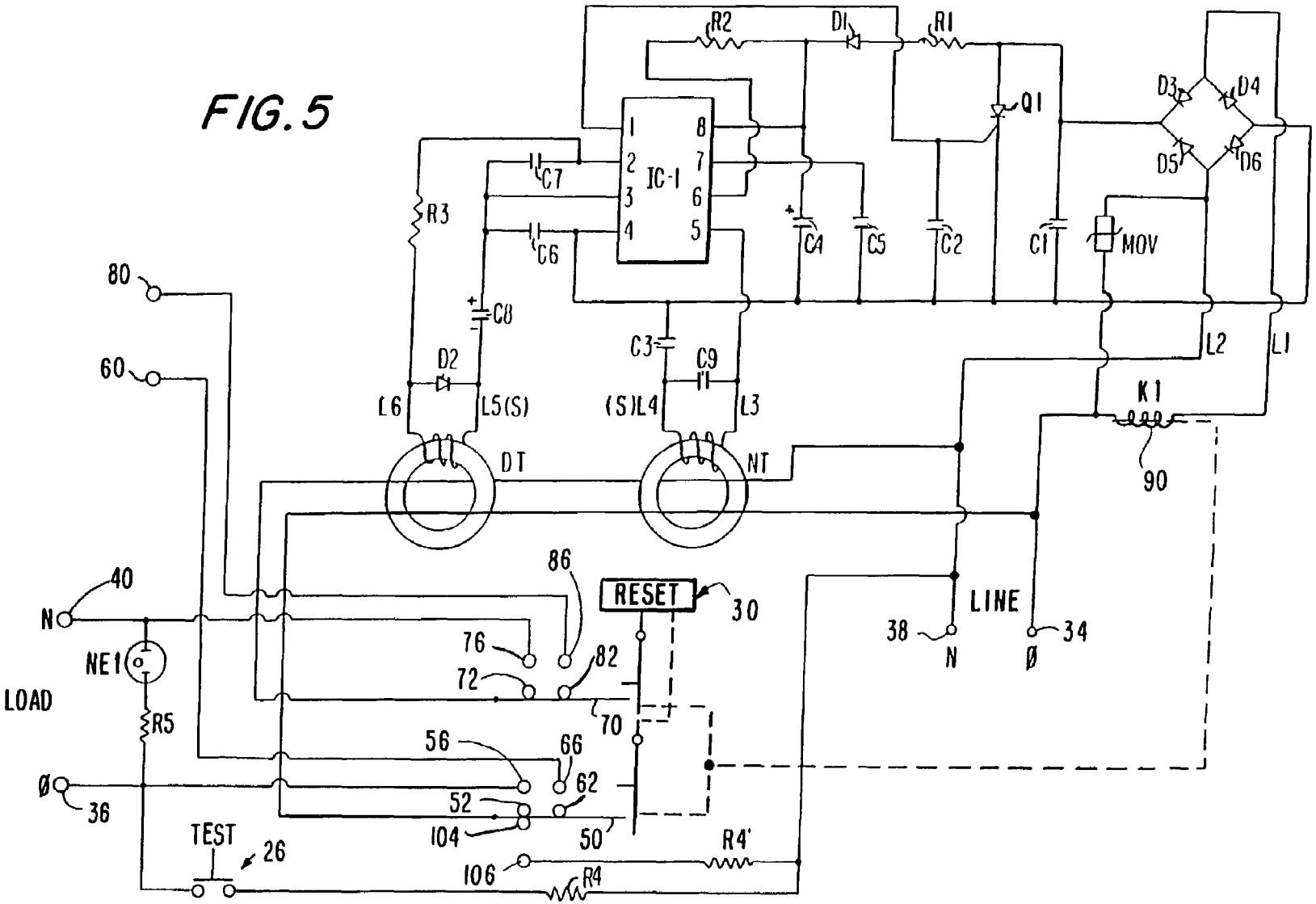
FIG. 5 is a schematic diagram of the circuit of the ground fault circuit interrupting device of FIG. 1.

Referring to the prior art schematic diagram shown in FIG. 5, the circuit of the GFCI for detecting faults utilizes bridge contacts to isolate the load conductors from the receptacle contacts when the device is in a fault state. More specifically, movable arm 50 supports two contacts 52 and 62. Contact 52 cooperates with contact 56 and contact 62 cooperates with contact 66. In operation, when the GFCI is in its no fault state, contacts 52, 56 are closed and contacts 62, 66 are closed to allow receptacle contact 60 to be connected to the load phase contact 36. When the GFCI is in its fault state, contacts 52, 62 are not connected to contacts 56, 66 respectively. Contacts 52, 56 and 62, 66 are referred to as bridge contacts. They provide isolation of the line phase contact 34 from the load phase contact 36 and the receptacle contact 60 when the GFCI is in a fault state. In a similar manner, bridge contacts 72, 76 and 82, 86 provided isolation of the line neutral contact 38 from the load neutral contact 40 and the receptacle contact 80. Because the invention here disclosed comprises the structure of a blocking member to prevent a plug from being inserted into the receptacle when the GFCI is in a fault state, the bridge contacts can be eliminated. Referring to FIG. 6, movable contact 62 and fixed contact 66 are eliminated and lead 61 from receptacle contact 60 is connected at point 39 directly to lead 37 which connects contact 36 to contact 56. In a similar manner, movable contact 82 attached to movable arm 70 and which cooperates with fixed contact 86 are eliminated, and lead 81 from receptacle contact 80 is connected at point 43 directly to lead 41 which connects contact 40 to contact 76. With the circuit of FIG. 6, the contacts 60, 80 of the receptacle and the contacts 36, 40 of the load are connected together and they, in turn, are connected to the line contacts 34, 38 only when the GFCI is in a no fault state. Under normal operating conditions when the line does not have a fault, current flow is from the line contacts through the GFCI to the load contacts 36, 40 and to the receptacle contacts 60, 80.

Although the components used during circuit interrupting and device reset operations as described above are electromechanical in nature, the present application also contemplates using electrical components, such as solid state switches and supporting circuitry, as well as other types of components capable of making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed is:

1. A circuit interrupting device comprising:

a housing:

a phase conductive path and a neutral conductive path each disposed at least partially within said housing between a line side and a load side, said phase conductive path terminating at a first connection capable of being electrically connected to a source of electricity and a second connection capable of conducting electricity to at least one load and at least one user accessible load, and said neutral conductive path terminating at a first connection capable of being electrically connected to a source of electricity and a second connection capable of providing a neutral connection to said at least one load and said at least one user accessible load;

said circuit interrupting device being free of bridge contacts which provide a third connection capable of conducting electricity to at least one user accessible load and another third connection capable of providing a neutral connection to said at least one user accessible load;

a circuit interrupting portion disposed within said housing comprising a movable arm having contacts thereon adapted to disengage from fixed contacts to cause electrical discontinuity in said phase and neutral conductive paths between said line side and said load side upon the occurrence of a predetermined condition;

a reset portion disposed at least partially within said housing and configured to reestablish electrical continuity in said phase and neutral conductive paths:

said circuit interrupting device further comprising a reset lockout portion that prevents reestablishing electrical continuity in said phase and neutral conductive paths if said circuit interrupting portion is non-operational, if an open neutral condition exists or if a reverse wiring condition exists;

wherein said reset portion comprises:

a reset button;

at least one reset contact which is capable of contacting at least a portion of said phase conductive path to cause said predetermined condition, wherein if said circuit interrupting portion is operational, the circuit interrupting portion is activated to disable said reset lockout portion and facilitate reestablishing electrical continuity in said phase and neutral conductive paths, and wherein if said circuit interrupting portion is non-operational, said reset lockout portion remains enabled so that reestablishing electrical continuity in said phase and neutral conductive paths is prevented; and blocking means coupled to the movable arm of the circuit interrupting portion to block the second connection of said phase conductive path and of said neutral conductive path from being connected to a user accessible load upon the occurrence of said predetermined condition.

* * * * *